US005348238A

United States Patent [19]

Yamauchi et al.

[11] Patent Number: 5,348,238

[45] Date of Patent: Sep. 20, 1994

[54] DOUBLER WINDER

[75] Inventors: Toshio Yamauchi, Kyoto; Hiroshi Uchida, Omihachiman, both of Japan

[73] Assignee: Murata Kikai Kabushiki Kaisha, Kyoto, Japan

[21] Appl. No.: 920,998

[22] Filed: Jul. 28, 1992

[30] Foreign Application Priority Data

Jul. 30, 1991 [JP] Japan ..... 3-189998
Aug. 27, 1991 [JP] Japan ..... 3-75735[U]

[51] Int. Cl.[5] ..... B65H 54/06

[52] U.S. Cl. ..... 242/18 R; 242/42; 242/43 R; 28/252

[58] Field of Search ..... 242/42, 18 R, 18 DD, 242/43 R, 36

[56] References Cited

U.S. PATENT DOCUMENTS 4,371,122 2/1983 Schuller ..... 242/43 R
4,494,702 1/1985 Miyake et al. ..... 242/18 R
4,515,320 5/1985 Slavik et al. ..... 242/43 R X
4,789,112 12/1988 Schippers et al. ..... 242/18 R X

FOREIGN PATENT DOCUMENTS 397453 10/1991 Japan .

*Primary Examiner*—Stanley N. Gilreath
*Attorney, Agent, or Firm*—Spensley Horn Jubas & Lubitz

[57] ABSTRACT

In a winder provided with a control device capable of independently controlling rotational speeds of both motors for a friction roller having a winding package placed thereon and a traverse mechanism, a driving method for a winder comprising: obtaining a difference between an output of a first sensor for detecting a rotational speed of a package and an output of a second sensor for detecting a rotational speed of a friction roller, attenuating the difference to an adjustable value to prepare a correction value, subtracting the correction value from the output of the second sensor, and using the result obtained therefrom as a control input of the both motors to enable selection of a plurality of winding patterns.

4 Claims, 14 Drawing Sheets

DOUBLER WINDER

BACKGROUND OF THE INVENTION

The present invention relates to a doubler winder and a driving method for a doubler winder.

Related Art Statement

A winder, that is, a winding apparatus such as a doubler winder or a winder is designed to wind a yarn while suitably traversing it.

As shown in FIG. 9, a conventional winder of this kind of composed of a friction roller 2 in contact with a winding package 1 to rotate the latter, a traverse cam 4 having a cam groove 3 in a surface thereof, and a traverse guide 5 for guiding a yarn Y. The traverse guide 5 for guiding the yarn Y is relatively moved along the cam groove 3 whereby the yarn Y from a yarn feed package 6 is wound as a desired winding package 1 via a balloon guide 7 and a tensor 8.

Methods for winding a yarn by such a winder as described above include a precision winding and a random winding.

As shown in FIGS. 10*a* and 10*b*, the precision winding is a winding method with the wind number W constant in which the rotational speed R1 of the traverse cam 4 is gradually reduced at the same ratio as the rotational speed Rp of the winding package 1 and in synchronism therewith. As shown in FIGS. 11*a* and 11*b*, the random winding is a winding method with an angle of wind $\theta$ constant, in which the rotational speed Rt of the traverse cam 4 is made constant irrespective of a change in the rotational speed Rp of the winding package 1.

The aforesaid conventional winding methods have respective merits and demerits.

In the precision winding, the angle of wind $\theta$ decreases as a winding diameter $\Phi$ of a package increases, and therefore the precision winding has an advantage capable of preventing a so-called ribbon winding. However, the number of wind W is constant, and the angle of wind $\theta$ gradually decreases as a winding diameter $\Phi$ increases. Therefore, even if the number of wind W is selected so that a suitable angle of wind $\theta$ results as a whole, it is unavoidable that the angle of wind $\theta_1$ is large (FIG. 10*a*) at a small diameter range while the angle of wind $\theta_2$ is small (FIG. 10*b*) at a large diameter range. Because of this, "off lease winding" or "stitching" occurs (wherein the wound yarn is dropped toward the outside at an end portion of a package) at a large diameter range and an unwinding-ability becomes poor, and a winding width is reduced at a small diameter range to thereby produce wrinkles, greatly influencing on subsequent steps.

On the other hand, in the random winding, since the angle of wind $\theta_3$ is constant, off lease winding is hard to occur but the number of wind W becomes less at a large diameter range, thus failing to obtain a desired winding density resulting in a wound package 1 having a low density. Particularly in the case of a doubler which forms a yarn feed package for feeding to a two-for-one twister, since there is a limit in volume of a yarn feed package in the two-for-one twister, a package having a large density is demanded.

When automatic yarn splicing is carried out by a splicing carrier in a doubler winder, it often occurs that either yarn on the winding package side is wound additionally by once so that yarns are separated. This causes yarn breakage or the like when a package is unwound in the subsequent step such as twisting. The aforesaid splicing carriage is not provided with an apparatus for detecting such a separated winding as described above, failing to eliminate the separated winding which adversely influences on the subsequent steps.

OBJECT AND SUMMARY OF THE INVENTION

A first object of the present invention is to provide a driving method for a winder in which a pattern of a traverse of a yarn can be selected according to a using object of a package and the control of a friction motor and a traverse motor can be simply made.

A second object of the present invention is to provide an apparatus for detecting a separated winding in order to remove a separated winding which occurs when automatic splicing is carried out by a splicing carriage in a doubler winder.

A third object of the present invention is to provide a doubler for producing a doubled yarn which has less possibility of occurrence of a separated winding.

According to the present invention, there is provided, in a winder provided with a control device capable of independently controlling rotational speeds of both motors for a friction roller having a winding package placed thereon and a traverse mechanism, a driving method for a winder comprising: obtaining a difference between an output of a first sensor for detecting a rotational speed of a package and an output of a second sensor for detecting a rotational speed of a friction roller, attenuating said difference to an adjustable value to prepare a correction value, subtracting said correction value from the output of said second sensor, and using the result .obtained therefrom as a control input of said both motors to enable selection of a plurality of winding patterns.

Further, the present invention provides a separated winding detection apparatus, which is disposed above and frontwardly of a splicing carriage for a doubler and advances substantially simultaneously with a reversal of a winding package and a suction rotation of a suction mouth at the time of replacement of a yarn feed package or yarn breakage, said apparatus comprising a guide plate having a groove with a deep end thereof spread open in a central portion thereof, left and right yarn gathering levers for introducing a yarn into the deep end of said groove as said advancement takes place, left and right sensors of which extreme ends are directed in directions of yarns when positioned on both sides of the deep end of said groove, a separator run in between the yarns when the sensors simultaneously detect the yarns, and left and right cutters actuated after the running of the separator to cut the yarns.

In the separated winding detection apparatus configured as described above, when the apparatus advances substantially with the reversal of the winding package and the suction rotation of the suction mouth at the time of replacement of a yarn feed package or yarn breakage, a yarn on the winding package side is disengaged from a traverse cam and introduced into the deep end of the groove of a guide plate by the yarn gathering levers. When the yarn is wound being separated, the sensors simultaneously detect yarns and the separator run in between the yarns, and after this, the preceding yarn for traverse stays as it is within a range of operation of cutters at the deep end of the groove of the guide plate while the succeeding yarn impinges on the separator to be deviated from the range of operation of the cutters. Then the cutters are actuated to cut only the preceding yarn for traverse.

DETAILED DESCRIPTION OF PREFERRED EMBODIMENT

The random winding and the precision winding will be further described.

Figure 7:
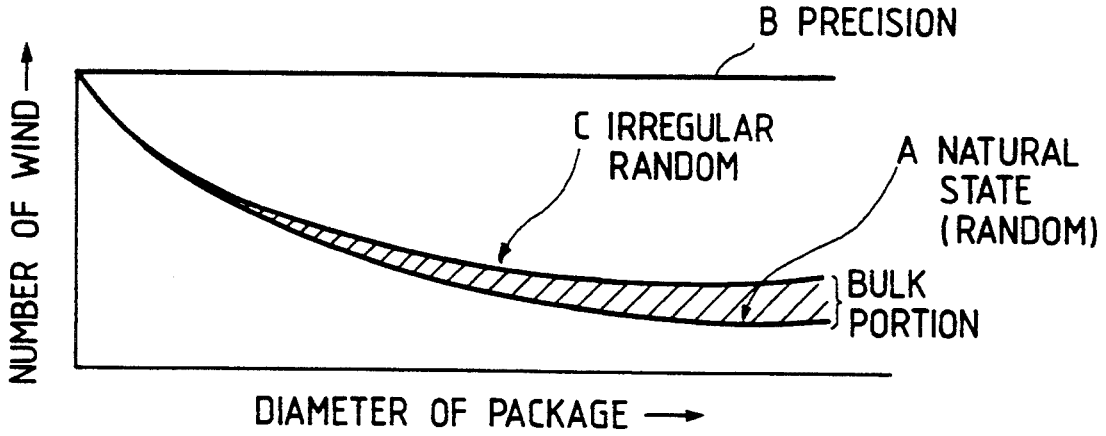
FIG. 7 PRIOR ART
FIG. 7 is a view showing the relationship between a package diameter and an angle of wind.

When both motors for a winding package and a traverse mechanism are kept to be driven at a constant speed always without imposing any control, the number of wind (the number of windings wound per rotation of a package) gradually reduces as a package diameter increases as shown in FIG. 7. This is the random winding (curve A in FIG. 7) whereas the precision winding (curve B in FIG. 7) is shown in which winding is done in a manner such that the number of wind is always constant. However, when an intermediary between the random winding and the precision winding, that is, a relative speed of the motor is changed little by little, for example, when the motor speed of the traverse mechanism is made higher (the traverse is faster) than the random winding and the angle of wind is made larger, the intermediate state between the precision winding and the random winding (irregular random winding: curve C in FIG. 7) can be prepared. As described above, the random, precision, and irregular random or the angle of wind of random winding can be selected.

Figure 8:
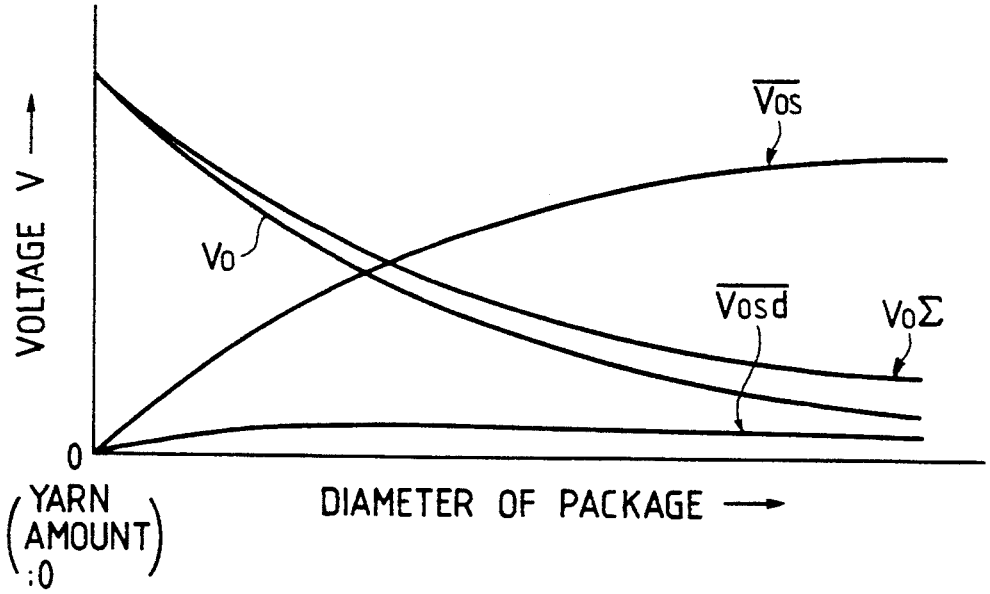
FIG. 8 PRIOR ART
FIG. 8 is a view for explanation of operation in the case of the irregular random winding in the prior application (Japanese Laid-open Utility Model Application No. 3-97453).
Figure 9:
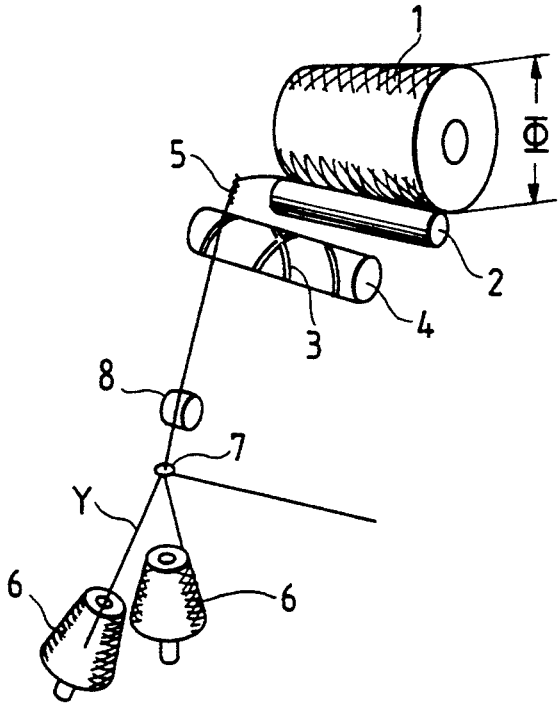
FIG. 9 PRIOR ART
FIG. 9 is a perspective view showing a conventional doubler winder.
Figure 10A:
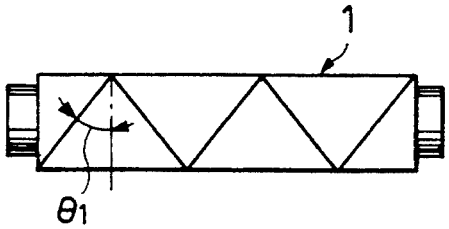
FIG. 10a PRIOR ART
FIGS. 10*a* and 10*b* are side views of a winding package for explaining a conventionally known precision winding.
Figure 10B:
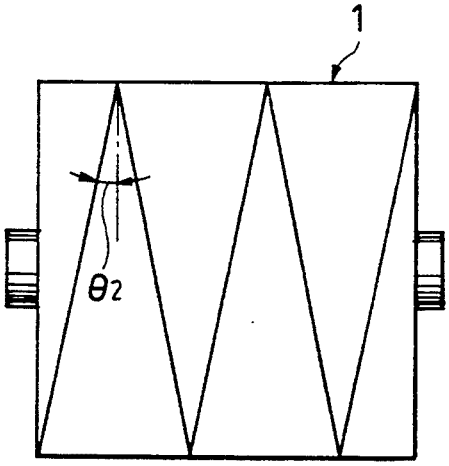
FIG. 10b PRIOR ART
Figure 11A:
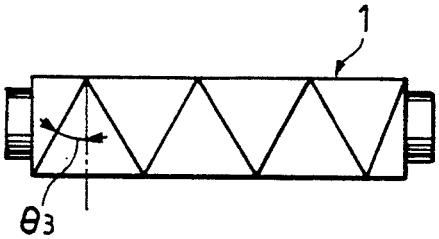
FIG. 11a PRIOR ART
FIGS. 11*a* and 11*b* are side views of a winding package for explaining a conventionally known random winding.
Figure 11B:
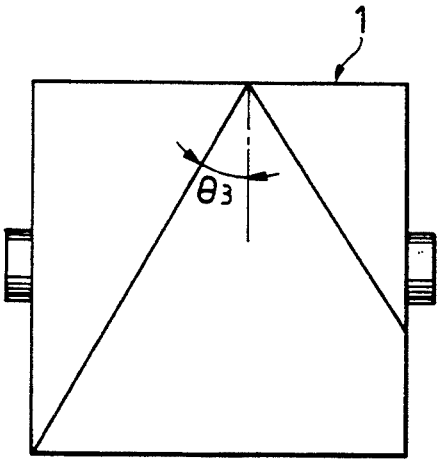
FIG. 11b PRIOR ART

Specific means is disclosed in the prior application (Japanese Utility Model Laid-open No. 3-97453) proposed by the present inventor. In this application, the precision mode is mainly taken into consideration, in which a voltage VO obtained by digital to analog conversion of the rotational speed Rp of a winding package 1 comprises a command of a motor (TC motor) of a traverse cam in the precision mode. That is, in FIG. 8, a voltage VO obtained by digital to analog conversion of the rotational speed Rp of a package is used as a command reference voltage. In the case of the precision winding, the TC motor is controlled on the basis of the command voltage VO so that the number of wind is constant irrespective of a diameter of the package. In the case of the random winding, the voltage VO is changed into a voltage $\overline{Vos}$ (—means an inversion) which is shifted and inverted so that an initial value (when a yarn layer of a package is 0) is 0 V, and the inverted voltage $\overline{Vos}$ is added to the command voltage Vo in the precision winding to prepare a control voltage of the random winding. In the control of rotational speed of the TC motor in the intermediary between the precision winding and the random winding, the shifted and inverted voltage $\overline{Vos}$ is divided to obtain a bulk voltage $\overline{Vosd}$ (a bulk voltage). The thus bulk voltage $\overline{Vosd}$ is added to the original output voltage VO of the digital to analog converter to obtain a curve of a voltage VOΣ bulked by the voltage $\overline{Vosd}$ from the voltage VO. Accordingly, when the voltage VOΣ is used as a command voltage to be actually applied to an inverter of the TC motor, the command voltage VOΣ can be regulated according to the magnitude of the bulk voltage $\overline{Vos}$, whereby the value can be adjusted and set to a suitable value (the way of winding) from the state of the bulk voltage $\overline{Vos}=0$ (random winding) to the state of $\overline{Vos}=Vo$. That is, the modes of the random winding, the precision winding, and the intermediate irregular random winding can be selected.

However, in the case of the aforementioned prior application, the control of operation after entry into the steady state is very smoothly carried out but since the precision mode is mainly taken into consideration, when a mode is set close to the random mode, there arises the following problem at the time of start or stop.

Figure 6:
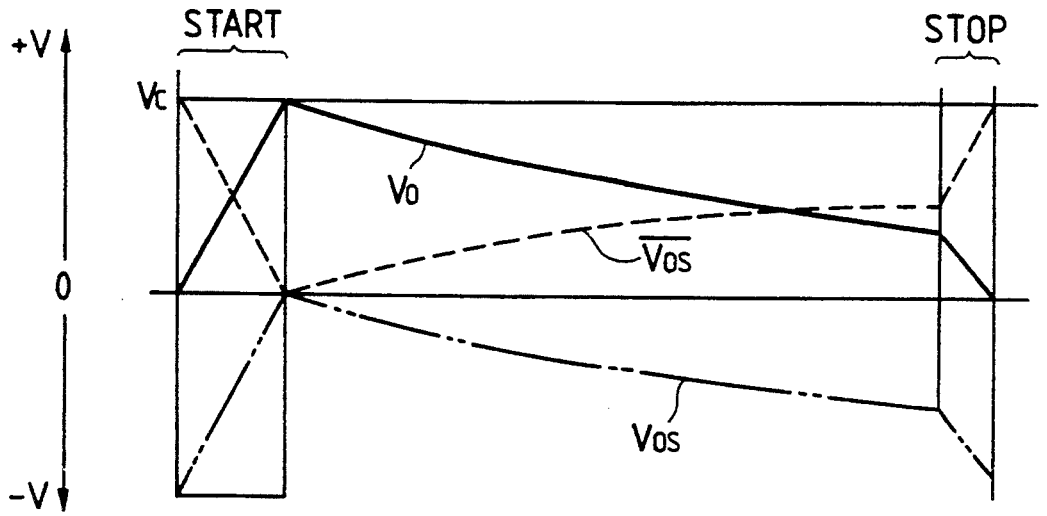
FIG. 6 PRIOR ART
FIG. 6 is an explanatory view of operation in the case where a mode comes close to the random mode in the prior application (Japanese Laid-open Utility Model Application No. 3-97453).

In consideration of a section at the time of start and stop, this section is exaggeratedly depicted in FIG. 6. As explained in connection with FIG. 8, in the control of the random mode, in the constant speed rotation area of both the motors (friction motor and TC motor), the inverted voltage $\overline{Vos}$ with the voltage $\overline{Vos}$, in which the voltage Vo is shifted to an initial value, inverted is added to the voltage Vo to prepare a constant voltage Vc. However, in the start section and the stop section, the voltage Vc while the rotation of the package increases to a constant speed rises, and when the inverted voltage $\overline{Vos}$ obtained by shifting the voltage Vo to an initial valve and inverting it is added, the control voltage of the TC motor obtained is only the control voltage Vc which is not different from the constant speed operation. As described above, in the mode close to the random mode, the command voltage (=Vo) with respect to the TC motor is always a constant value Vc at the time of start, and there occurs a great difference in relation of the rotation of the package simultaneously with the start, resulting in occurrence of disturbance of winding. The same is true for the stoppage.

The method of the present invention has reversed a method of conception in the prior application wherein a random mode is mainly taken into consideration whereby not only at the steady-state but also at the time of start and stop, smooth control can be made. In this case, there is provided no signal source capable of accelerating and decelerating a motor (a TC motor) of a traverse cam proportional with a package at the time of start and stop. Accordingly, to break this, for example, a new rotational sensor 12 is provided on a shaft of a friction roller 2 to obtain a signal (VFR) of a TC motor in synchronism with start and stop.

In shifting to a precision mode, a voltage (rotational speed digital to analog signal of a package) of a first sensor together with a voltage (digital to analog signal of an FR motor) of a second sensor are applied to a differential amplifier 23 to obtain a difference therebetween. This difference is representative of a size of a package at that time, and this difference portion is added to a same-phase adder to obtained an intended voltage. This signal is provided with a negative feedback element which shifts in a more stabilized direction than the system of the prior application, and is excellent in every respect as compared with the prior application.

Embodiments of the present invention will be described hereinafter with reference to the accompanying drawings.

Figure 1:
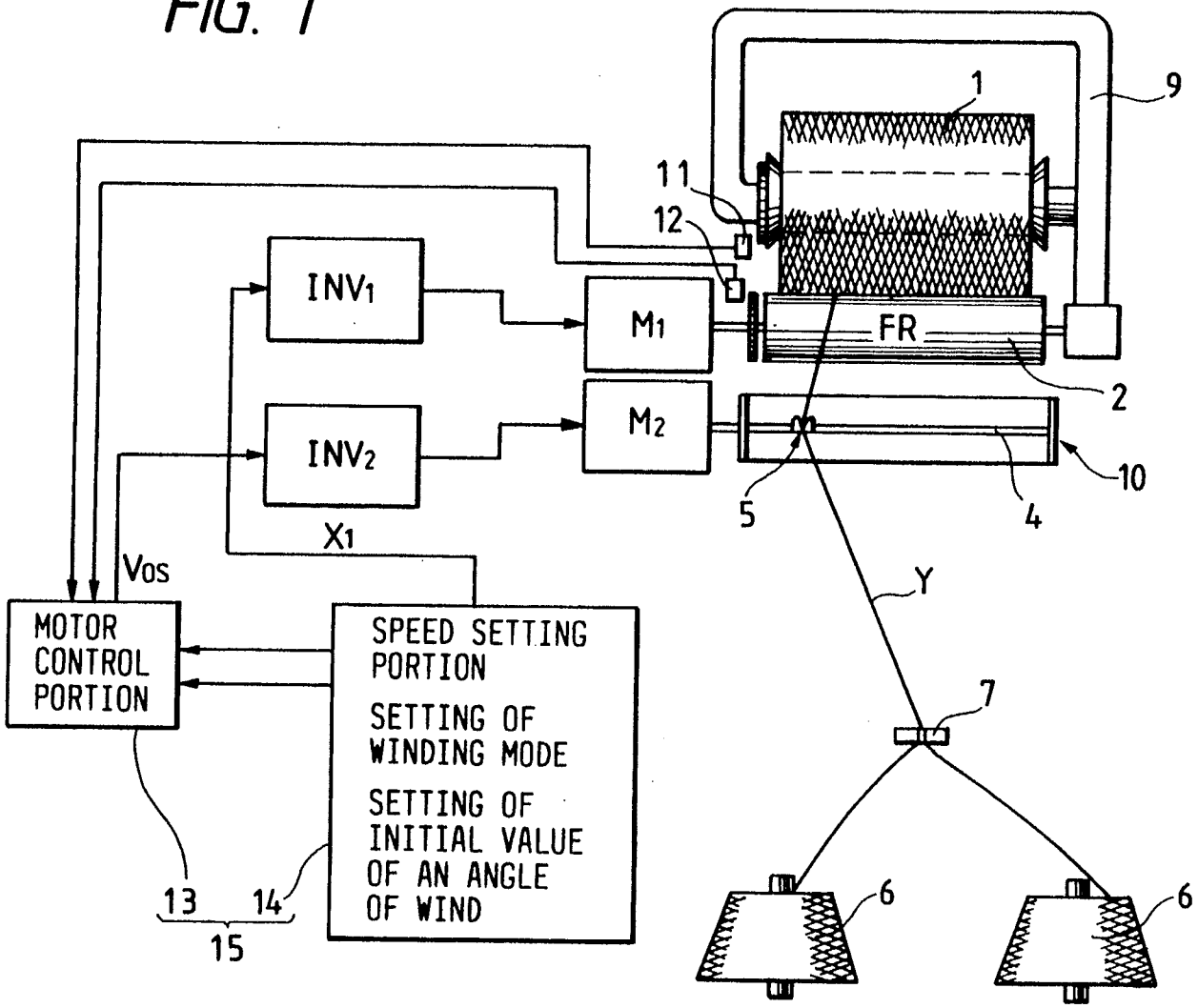
FIG. 1 is a schematic view of a doubler winder according to the present invention.
Figure 2:
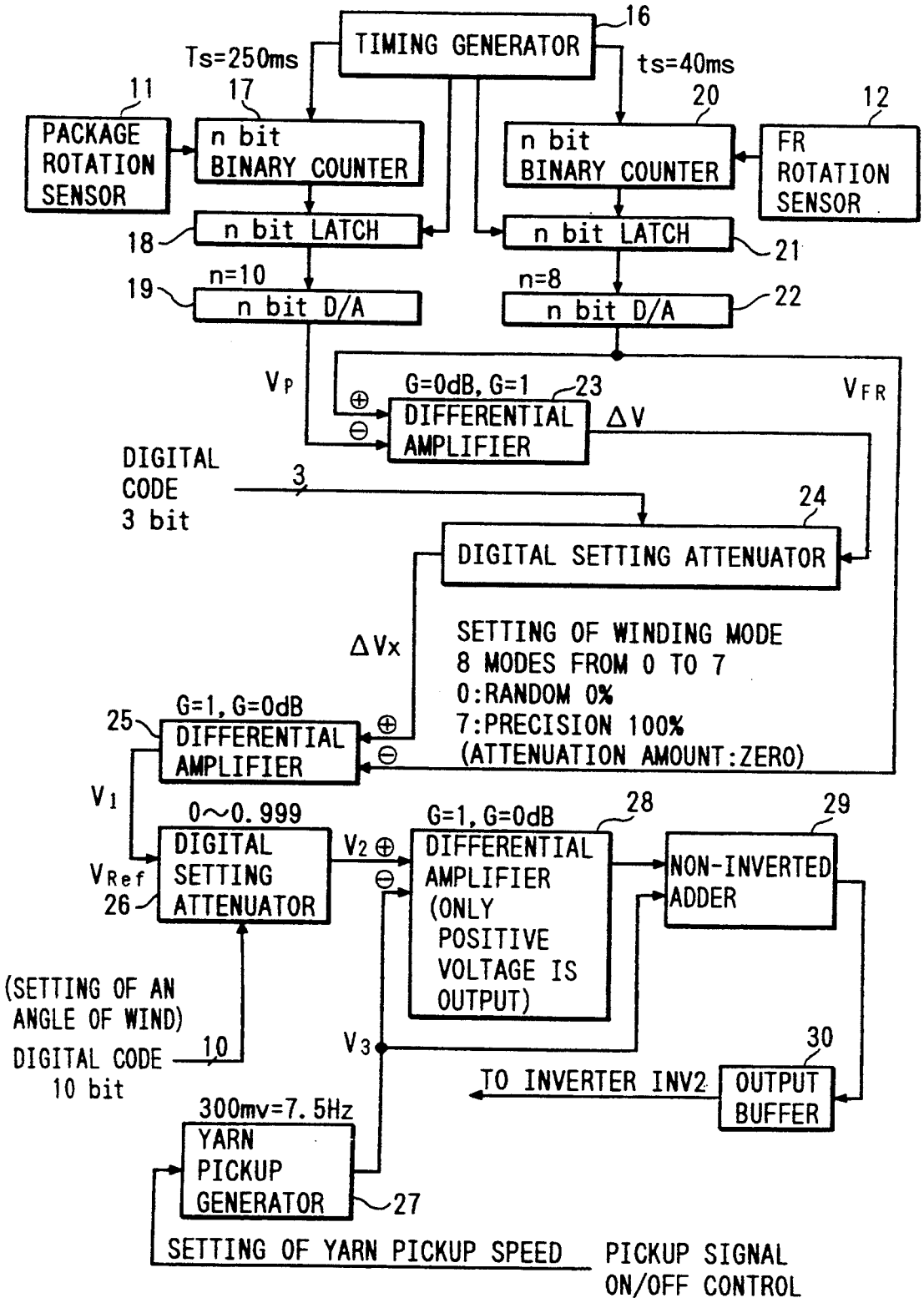
FIG. 2 is a structural view of a motor control portion shown in FIG. 1.

FIG. 1 shows a control system of a doubler winder having a motor for driving a package and a motor for driving a traverse mechanism. FIG. 2 shows a motor control section which enables random winding, irregular random winding and precision winding.

In FIG. 1, there comprises a friction roller 2 for driving a package 1, an FR motor M1 for driving the friction roller 2, a TC motor M2 for driving a traverse cam 4 of a traverse mechanism 10 for traverse, a rotational sensor (a first sensor) 11 provided on a package support mechanism 9 to know rotational speed of the package, a rotational sensor (a second sensor) 12 provided on an output shaft of the FR motor M1 to know a rotational speed of the friction roller 2 at the time of start and at the time of stop, inverters INV 1 and INV 2 for controlling the speeds of the motors M1 and M2, and a motor control portion 13 for giving a speed command to these inverters. Numeral 14 denotes a speed setting portion. This portion and a motor control portion 13 constitute a control device 15.

When a yarn speed is set by the speed setting portion 14, a command is given to the inverter INV 1 so as to obtain a rotational speed according to the set yarn speed whereby the FR motor M1 rotates. The TC control device 15 gives a command to the inverter so that the desired number of wind is obtained in the motor control portion 13 on the basis of a pulse of the rotational sensor 11 to control a TC motor M2.

FIG. 2 shows a configuration of the motor control portion 13. Binary counters 17 and 20 of n bits and latch circuits 18 and 21 extract pulses from the package rotational sensor (first sensor) 11 and the FR rotational sensor (second sensor) 12 by a unit time width prepared by a timing generator 16, which is then converted into the number of pulses per unit time. These pulses are sent to digital to analog converters 19 and 22, by which the pulses are converted into analog voltages VP and VFR, respectively.

Figure 3:
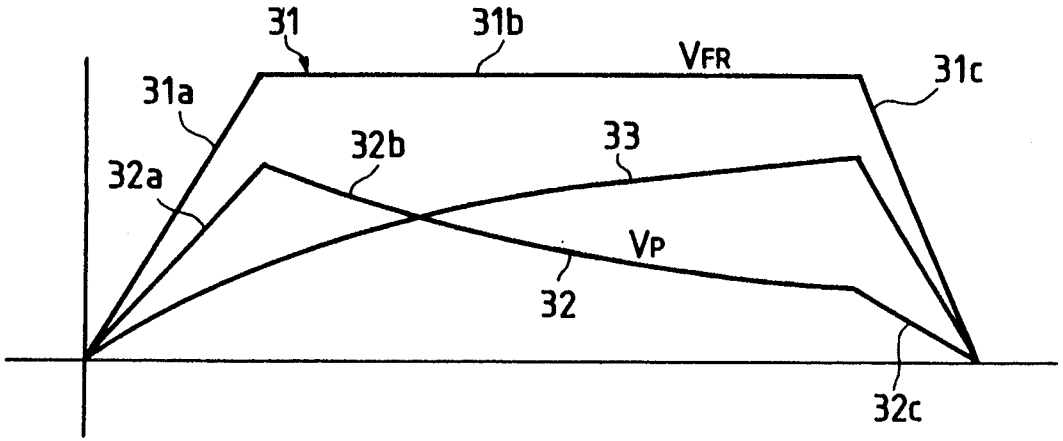
FIG. 3 is an explanatory view for the principle of operation of the present invention.

The analog voltage VFR obtained from the digital to analog converter 22 corresponds to a rotational speed of the friction roller 2, which rises as in 31*a* in a characteristic curve 31 of FIG. 3 at the time of start whereas at the time of steady-state, it is a constant speed as in 31*b* and at the time of stop, it falls as in 31*c*. On the other hand, the analog voltage VP obtained from the digital to analog converter 19 corresponds to a rotational speed of the package 1. Here, the rotational speed of the package 1 rises in synchronism with the friction roller 2 with only a take-up tube (a yarn layer of a package is 0) at the time of start, and after the friction roller 2 assumes a constant speed, the speed becomes low as the diameter of the package becomes large from small, as a consequence of which the number of pulses from the rotational sensor 11 reduces accordingly. Accordingly, as shown in FIG. 3, the voltage VP rises as in 32*a* in the characteristic curve 32 of FIG. 3 at the time of start, whereas at the time of steady-state, the voltage decreases as the package diameter increases as in 32*b*, and falls as in 32*c* at the time of stop.

Figure 4:
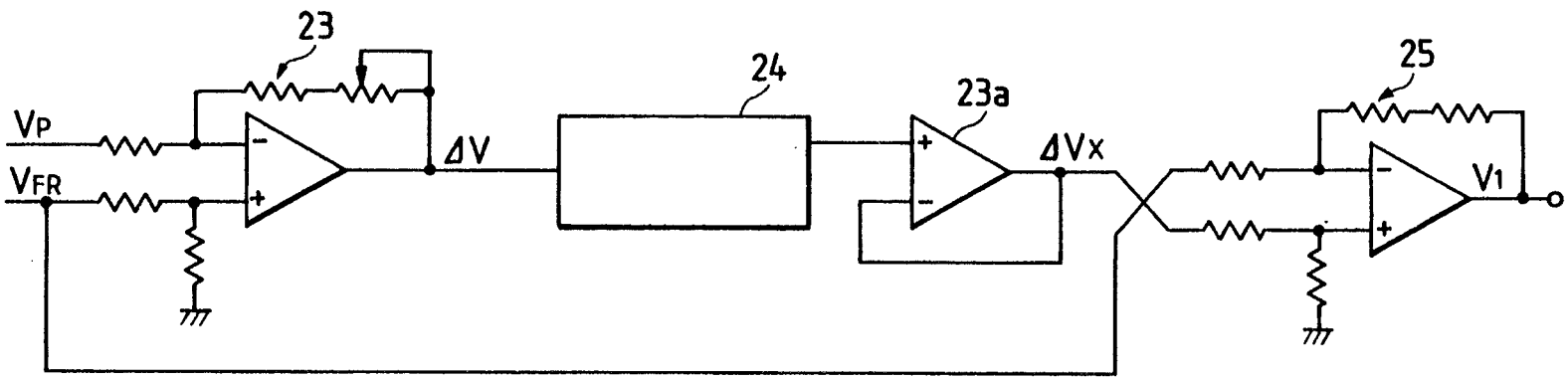
FIG. 4 is a view showing a specific circuit of a part of a motor control portion.
Figure 5:
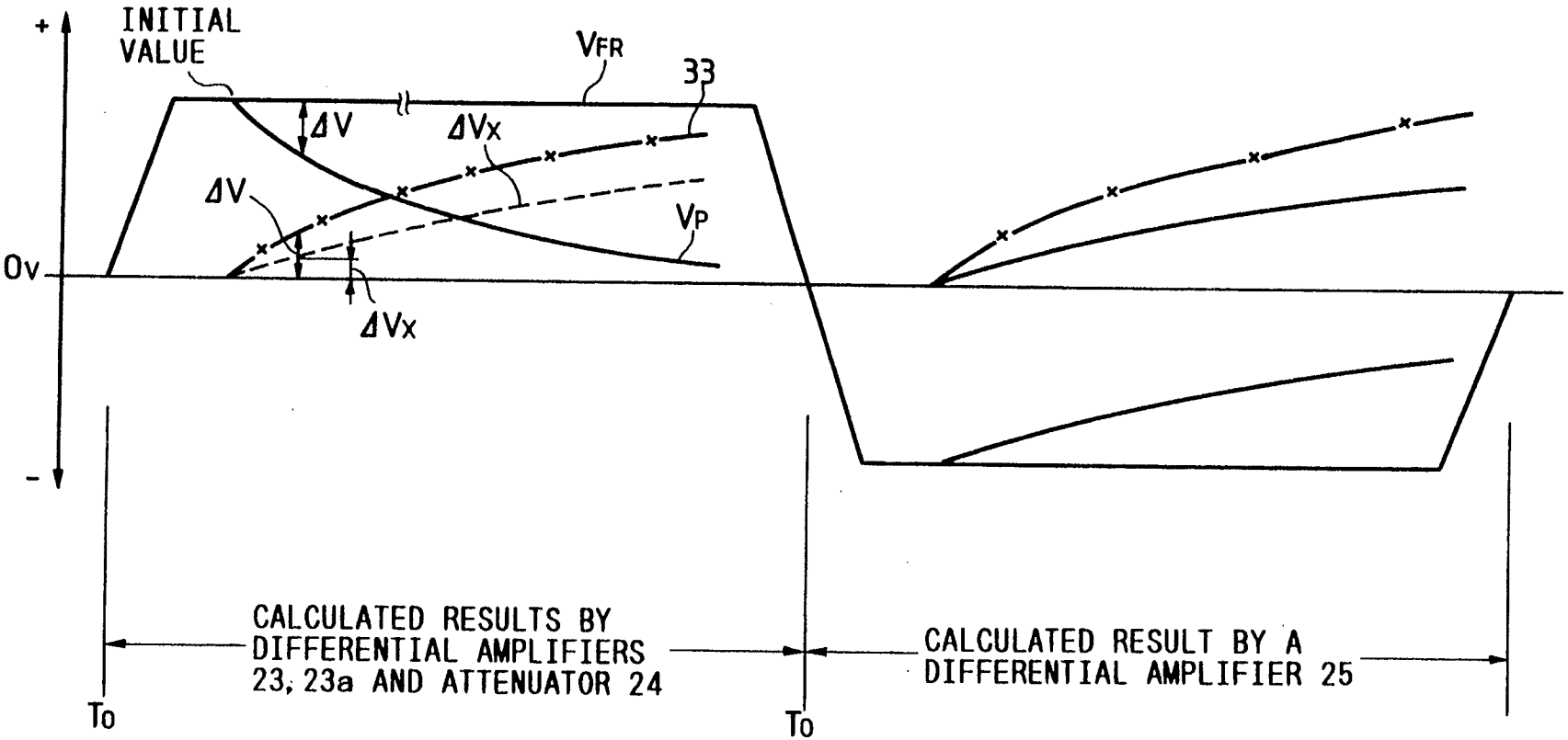
FIG. 5 is a view showing an example of operation of the circuit shown in FIG. 4.

FIG. 4 shows a specific circuit of a part (differential amplifiers 23, 23*a*, digital set attenuators 24 and a differential amplifier 25) of the motor control portion 13.

In FIG. 2 and FIG. 4, both the analog voltages VP and VFR are positive voltages. When a difference between the VP and VFR is obtained, a characteristic curve 33 of FIG. 3 is obtained. Here, the voltage of the initial value (the yarn layer of the package is in the range of 0) at the entry or immediately after the steady-state is made the same by the analog voltage VP of a rotational speed detection system of a package and the analog voltage VFR of a rotational speed detection system of the friction roller 2. For example, when an attenuator not shown is introduced to make adjustment so that the initial value with the winding yarn speed being 1600 m/min (yarn layer of package is 0) is the same voltage for both VP and VFR, a differential voltage $\Delta V$ (curve 33) appears at the time after passage of yarn layer zero. This differential voltage $\Delta V$ represents the size of the package 1 at that time. Accordingly, the differential voltage $\Delta V$ being a magnitude of one fold is subtracted from the voltage VFR, and a result therefrom is given to the inverter INV 2 of the TC motor M2. Then, the "precision winding" results, and when a value smaller than one fold in which the differential voltage $\Delta V$ is divided is given, a mode comes close to the random winding, and other improved random mode or random mode result.

To prepare an attenuated value (corrected value) $\Delta Vx$ to what extent reduction is made, the analog voltages VP and VFR are inputted into the differential amplifier 23 to obtain a difference $\Delta V$ between Vp and VFR, which is further inputted into a digital setting attenuator 24 to obtain an attenuated value which is divided into eight stages, for example. That is, the attenuator 24 is used as a winding mode setter, and the attenuated value is applied to a corrected value for setting the winding mode. Here, the mode setting "7" is a corrected value 100% (attenuated amount 100%) at the precision mode, the setting "6" to "1" are corrected values 80, 60, 50, 40, 30, and 20%, respectively at the improved random mode, and the setting "0" is a corrected value 0% at the random mode. These mode setting commands are issued from the speed setting portion 14 to the motor control portion 13 with the code of 3 bits, for example.

Next, the corrected value ΔVx is inputted into the differential amplifier 25, which is subtracted from the analog voltage VFR of the rotational speed detection system of the friction roller 2 to obtain a corrected difference voltage V. Here, the VFR is inputted into an inverted input terminal merely because a symbol of an output is made negative to conform with an input standard of the digital setting attenuator 26 in the next stage.

In FIG. 2, the aforesaid corrected difference voltage V1 is inputted into the digital setting attenuator 26 as a wind-angle setter. This digital setting attenuator 26 is composed of a digital to analog converter of about 10 bits to correct the voltage V1 to the relation with the angle of wind. That is, there is merely obtained a proportional relation in that the voltage V1 changes according to the rotational speed (size) of the package, and there is prepared a relation how the changing voltage V1 changes with a wind-angle set value as an index. More specifically, this voltage V1 is attenuated to 0 to 0.999 (value close to 1) fold and the thus attenuated value is indexed to a wind-angle set value given by a digital code signal so that an output voltage V2 changes according to the set angle of wind. For example, when a frequency of the FR motor M1 for determining the yarn speed is 47.2 Hz and the angle of wind is "4", the frequency of the TC motor M1 is 8.18 Hz. When a digital code for generating a voltage to obtain the 8.18 Hz is 8A, a digital value as a wind-angle set value corresponding to the angle of wind "4" assumes 8A. The voltage V1 itself is made to be shiftable as a whole according to the setting mode given by a digital code signal from the speed setting portion 14. This output voltage V2 is applied to the inverter INV2 of the TC motor M2 via an output buffer 30.

When a command is applied to the motor control portion 13 to which a desired mode is set by the setting portion 14, a corrected value of the attenuator 24 as a winding mode setter is determined, and respective modes of the random winding, precision winding and irregular random winding are obtained according to the aforesaid value.

To realize the random winding, the rotational frequency N1 of the FR motor M1 for driving a package and the rotational frequency N2 of the traverse mechanism 10 (assuming that the rotational amount and moving amount of the traverse mechanism are definite) may be set so that at the time of beginning of winding, a desired wind number or an angle of wind results. That is, the winding mode setting in the speed setting portion 14 is set to the random mode, and a command to the attenuator 24 is set to a corrected value % (attenuation amount 100%). At this time, the value is calculated by a built-in microprocessor so as to obtain a desired value from the speed setting portion 14, and a voltage V2 is applied to the inverters INV1 and INV2 via the motor controller portion 13 to provide the "random winding".

Also in the case of the precision winding, the rotational frequency N1 of the package 1 is set in a manner similar to that as described above. Next, a desired precision mode and a necessary set value of an angle of wind are instructed to the motor control portion 13 from the speed setting portion 14. Thereby, the corrected value 100% (attenuation amount 0% ) in the attenuator 24 results. Accordingly, the difference voltage ΔV appearing from the initial value in which in the aforementioned example, both VP and VFR are the same voltage is subtracted from the voltage VFR with a magnitude of one fold, and the voltage V2 according to a desired angle of wind is applied to the inverter INV2 of the TC motor M2 for driving a traverse mechanism to provide a "precision winding".

In the improved random mode, as one example, a mode setting instruction to the attenuator 24 is set as desired in the range of corrected value 20 to 80% . In this mode, the number of wind which reduces as winding advances is controlled (curve C in FIG. 7) so that the reduction amount is lessened than the natural state (curve A in FIG. 7), and a package having a high winding density as a whole is formed.

In the case of FIG. 2, other circuits are added in addition to the above circuit. That is, an output of the attenuator 26 is not directly removed, and between the attenuator 26 and the output buffer 30 are added a yarn pickup signal generator 27, a differential amplifier 28 and a non-inverted adder 29.

The yarn pickup signal generator 27 is a circuit for preparing a time necessary for a yarn guide (not shown) in a winder to effect a yarn pickup operation for bringing a yarn to its own guide position, that is, a voltage V3 necessary to give an adequate traverse speed to the INV2 for driving the TC motor. The yarn pickup signal generator 27 generates a voltage of 300 mv (7.5 Hz), for example, upon receipt of a yarn pickup signal to be turned ON and OFF in synchronism with switching of instruction of the FR motor M1. Since the voltage V3 is added by the non-inverted adder 29 while substrated by the differential amplifier 28 (only a positive voltage is outputted), an influence of the voltage V3 which is a pickup signal can be disregarded during winding of yarn.

In short, according to the present invention, the random winding, precision winding and irregular random winding, and the initial value of the angle of wind can be suitably selected. Moreover, even at the time of start and at the time of stop including the case where the mode comes close to the random mode, the winder can be driven without occurrence of disturbance of an angle of wind.

Next, it will be illustrated how a yarn is treated when a yarn breakage is occurred in the doubler winder as shown in FIG. 1. In this treatment, there is a problem that one of two yarns drawn from the package side is wound additionally by once so that the yarns are separated irrespective whether the yarn treatment is processed by an operator or by an automatic yarn splicing apparatus. This causes a yarn breakage or the like when a package is unwound in the subsequent step such as twisting. The conventional splicing carriage is not provided with an apparatus for detecting such a separated winding, failing to eliminate the separated winding which adversely influences on the subsequent steps.

This embodiment of the present invention relates to an apparatus for detecting a separated winding in order to remove a separated winding which occurs when automatic splicing is carried out by a splicing carriage in a doubler winder.

The separated winding detection apparatus according to this embodiment will be described with reference to FIGS. 12 to 17.

Figure 12:
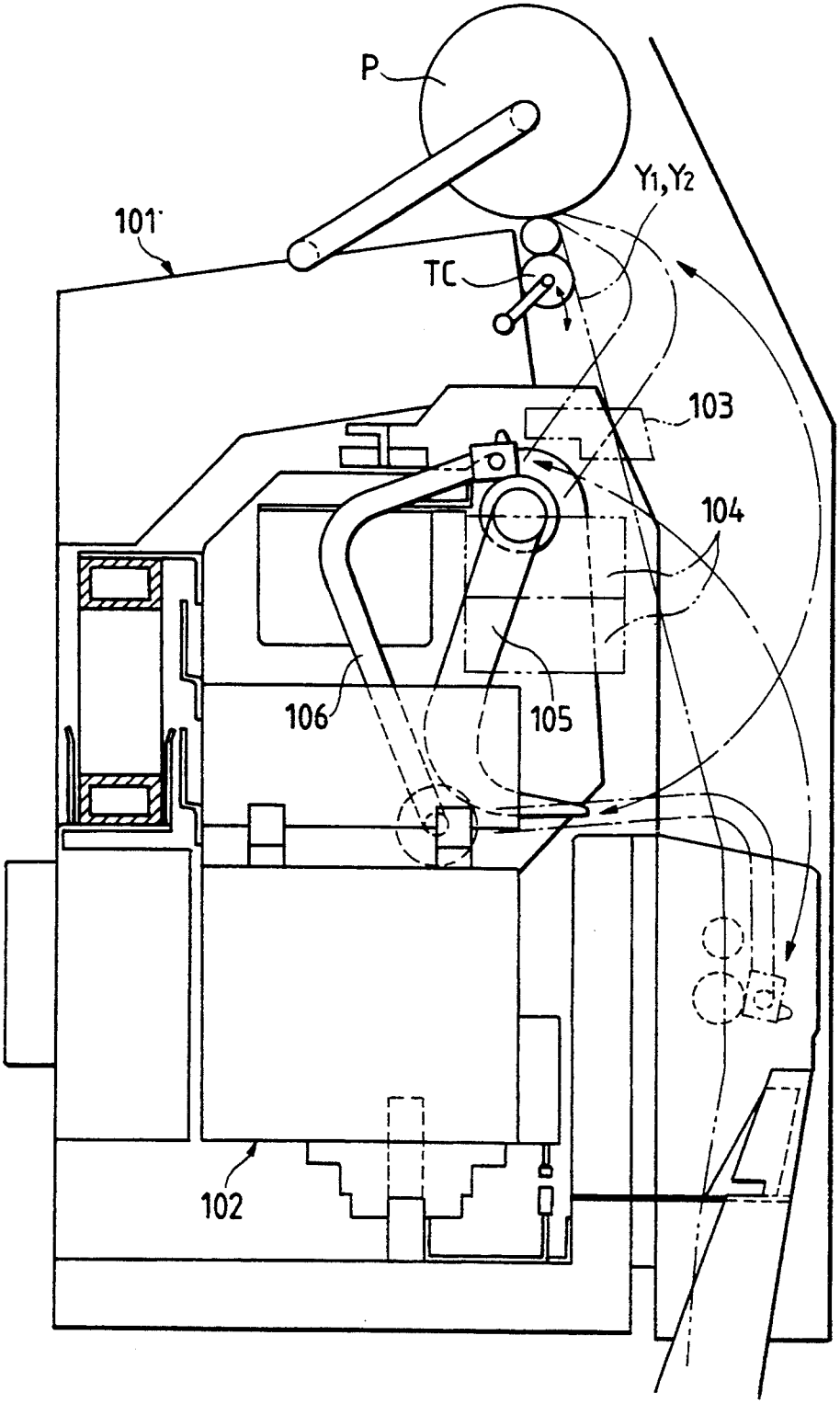
FIG. 12 is a side view of a doubler and a splicing carriage.

This separated winding detection apparatus 103 is disposed above and frontwardly of a splicing carriage 102 provided with two splicing devices 104 corresponding to two yarns, said devices 104 moving along units of a doubler winder 101, a suction mouth 105 for sucking and holding a yarn on the winding package P side to guide it toward the splicing devices 104, a relay pipe 106 for sucking and holding a yarn on the yarn feed package side not shown at the lower part of FIG. 12 to guide it toward the splicing device 104 side, and the like, as shown in FIG. 12, the apparatus 103 comprising an upper guide plate 107 having a groove 107*a* a deep portion of which is spread into a nose shape in a central portion thereof, a separator 108 disposed therebelow, left and right cutters 109, left and right sensors 110 disposed therebelow, a lower guide plate 111 disposed therebelow and having a narrow groove 111*a* in a central portion thereof, and left and right yarn gathering levers 112 disposed therebelow.

Figure 16:
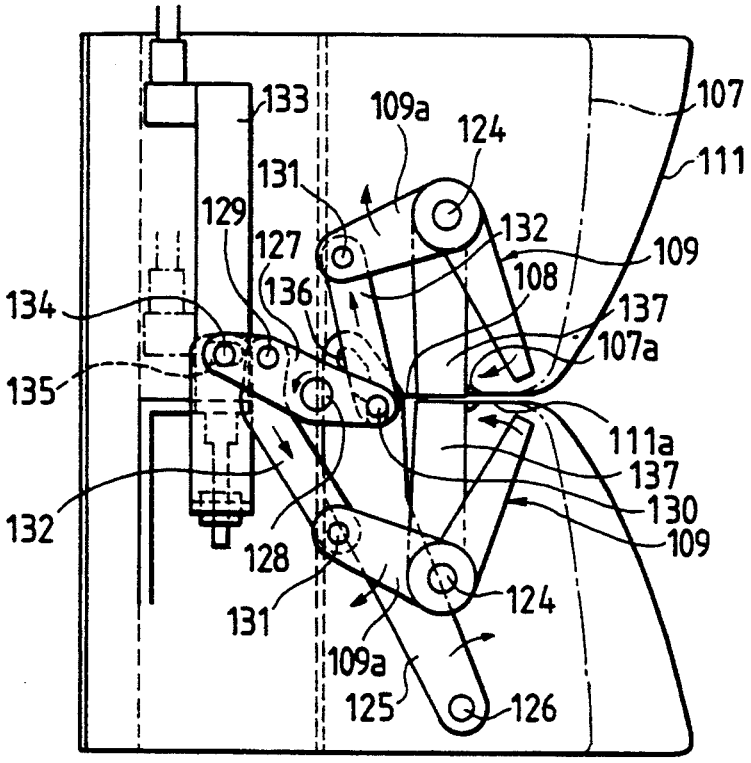
FIG. 16 is a plan view of a separator and a cutter portion of the separated winding detection apparatus.
Figure 17:
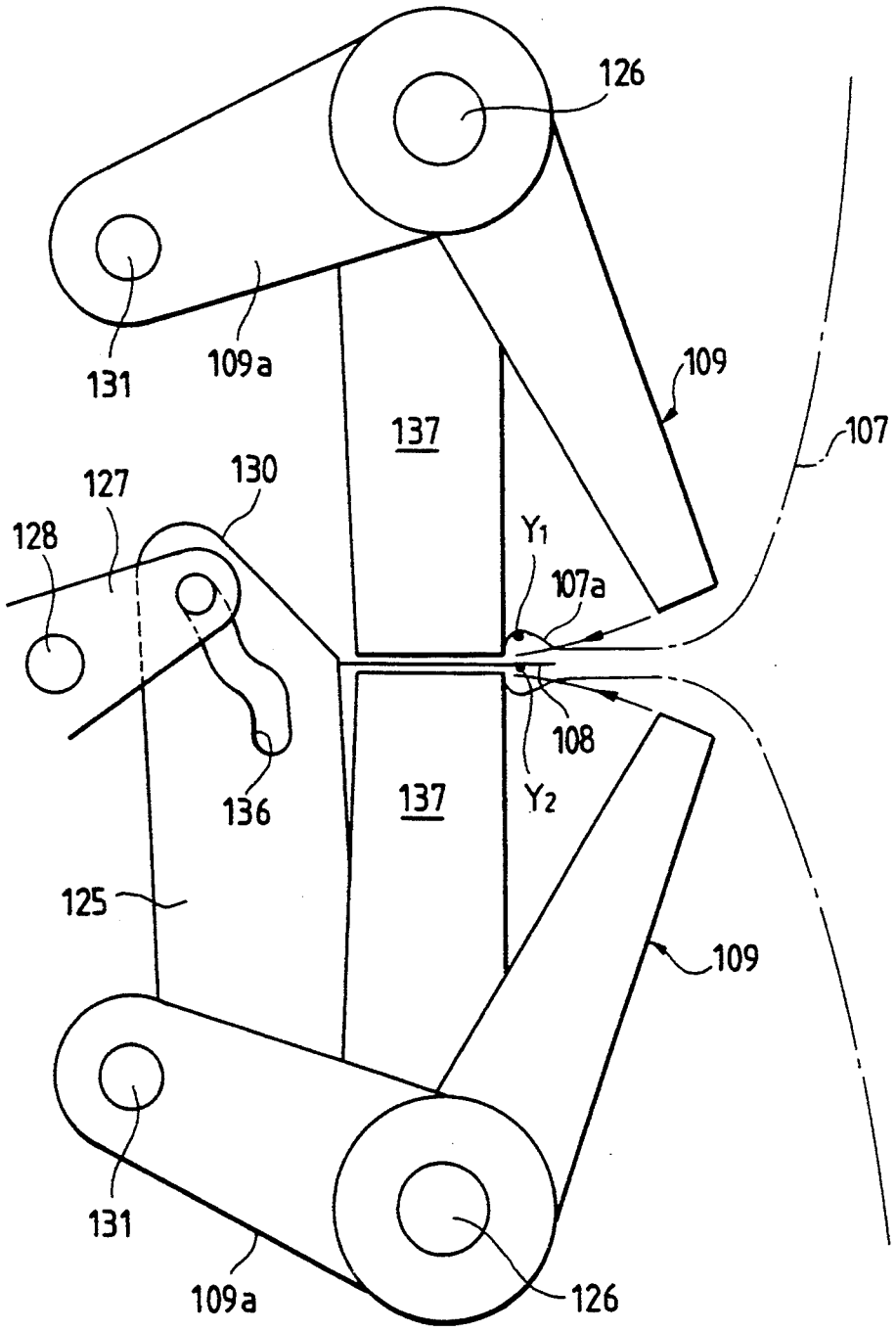
FIG. 17 is a plan view a separator, a cutter and a groove portion of an upper guide plate of the separated winding detection apparatus.

The upper guide plate 107 and the lower guide plate 111 are secured by means of screws to a guide plate mounting body 113 supported slidably in a lateral direction (the direction advancing to or 23 retracting from a yarn traveling path) on the piecing carriage 102, and the separated winding detection apparatus 103 as a whole can be moved in a lateral direction by operation of an air cylinder 114 acting on the guide plate mounting body 113. Grooves 107*a* and 111*a* of the guide plates 107 and 111, respectively, are generally superposed as viewed vertically, but the deep end of the groove 107*a* of the upper guide plate 107 positioned above is spread to be wider than the width of the groove 111*a* of the lower guide plate 111, as shown in FIGS. 14 and 16, so that two yarns are positioned on both sides of the spread portion at the deep end of the groove 107*a* when the separated winding takes place.

Figure 14:
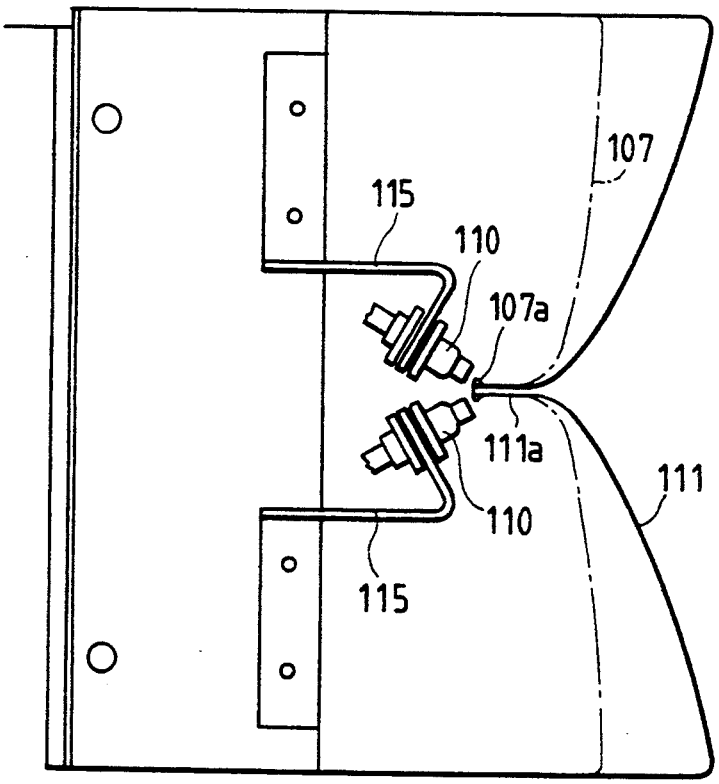
FIG. 14 is a plan view of a sensor portion of the separated winding detection apparatus.

As shown in FIG. 14, the left and right sensors 110 are secured to a bracket 115 screwed onto the lower guide plate 111, and the extreme end thereof is directed in the direction of the parting-wound yarns positioned 15 on both sides of the spread portion at the deep end of the groove 107*a* of the upper guide plate 107.

Figure 13:
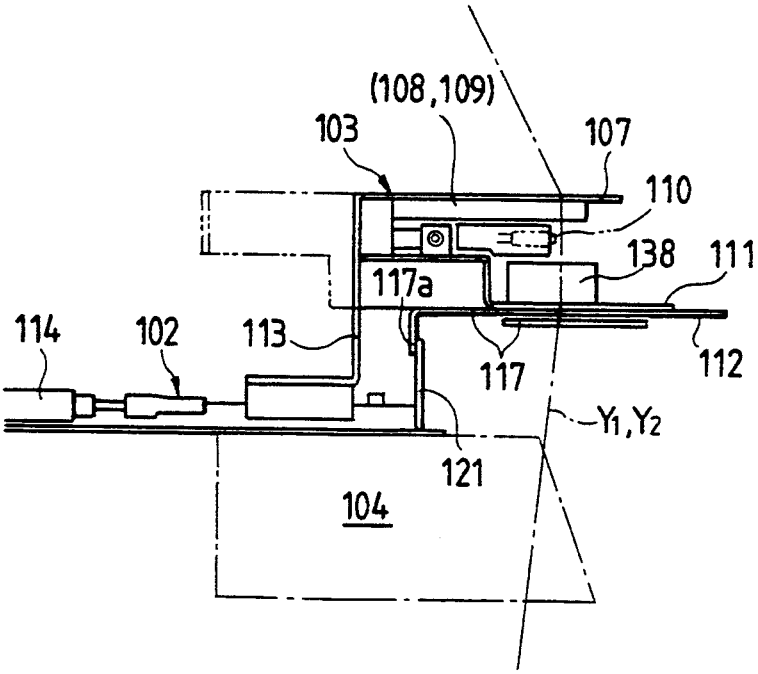
FIG. 13 is a schematic side view showing a positional relationship of members constituting a separated winding detection apparatus.
Figure 15:
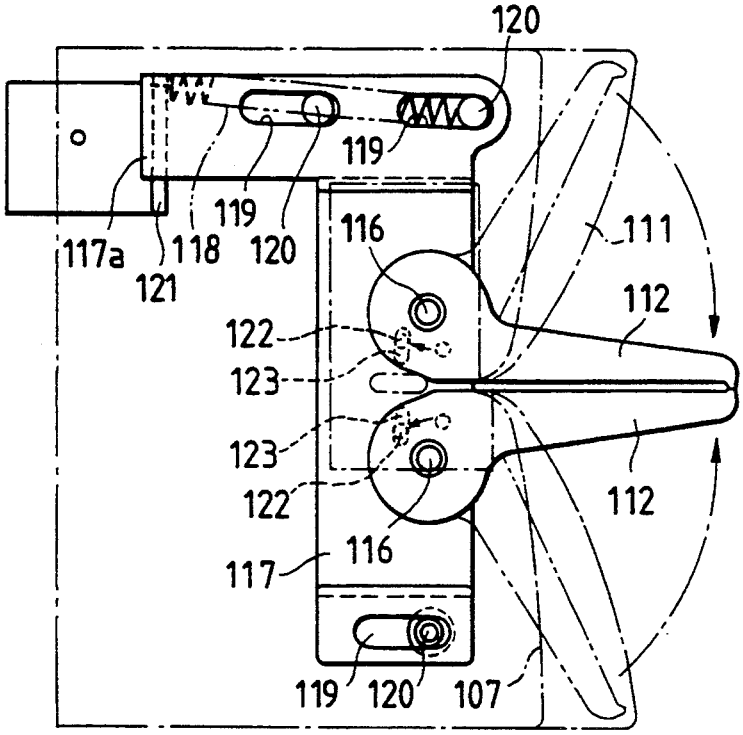
FIG. 15 is a plan view of a yarn gathering lever portion of the separated winding detection apparatus.

The left and right yarn gathering levers 112 are rotatably supported by a shaft 116 on the underside of the lower guide plate 111, as shown in FIG. 15. On the other hand, a yarn gathering mounting plate 117 is urged forward (to the direction advancing to the yarn 24 travelling path) by a spring 118 on the underside of the lower guide plate 111 and supported slidably in a lateral direction. Numeral 119 denotes a slot formed in the yarn gathering mounting plate 117, and a pin 120 secured to the lower guide plate 111 is engaged into the slot 119 to thereby protect the lateral sliding movement of the yarn gathering lever mounting plate 117. A right-hand rear end 117*a* of the yarn gathering mounting plate 117 forms a bended portion 117*a* which is bended downwardly and hung, as shown in FIG. 13, the bended portion 117*a* always being in a positional relation in abutment with a stopper 221 secured to the splicing carriage 102. A pin 122 is fixed at a position away from the rotational center of the lower surface of each yarn gathering lever 112, the pin 122 being engaged in a laterally long hole 123 formed in the yarn gathering lever mounting plate 117.

At the time of replacement of a package or yarn breakage, the suction mouth 105 sucks and hold the yarn end from the winding package P reversed and rotates down to the position indicated by the solid line of FIG. 12. Substantially simultaneously with the suction by the suction mouth 105, the air cylinder 114 causes the rod to extend to move the guide plate mounting body 113 and the separated winding detection apparatus 103 forwardly, and then the yarn on the winding package P side, that is, the upper yarn is disengaged from a traverse cam TC, and the lower guide plate 111 also advances. However, since the bended portion 117*a* is in abutment with the stopper 121, the yarn gathering lever mounting plate 117 is relatively rearwardly slidably moved with respect to the lower guide plate 111 against the force of the spring 118. At this time, the slot 123 is also moved backward relatively to the lower guide plate 111 in the state where the slot 123 is engaged with the pin 122, and therefore, the yarn gathering levers 112 mounted on the lower guide plate 111 are rotated internally about the shaft 116 each other. By the rotation of each yarn gathering lever 112 internally, the yarns on the winding package P side opened each other are drawn toward the center and introduced into the grooves 107*a* and 111*a* of the guide plates 107 and 111, respectively, as shown in FIG. 15. Also when the upper yarns are in the normal state, they are guided into the grooves 107*a* and 111*a*.

Each of the cutters 109 is rotably supported by a shaft 124 on the lower surface of the upper guide plate 107, and the separator 108 is projected frontwardly of the separator mounting plate 125 rotatably supported on the lower surface of the upper guide plate 107 by the shaft 126. A pivotable lever 127 is pivotably supported by a shaft 128 on the lower surface of the upper guide plate 107, and the other end of a rod 132 rotatably supported by a pin 131 on an arm 109*a* of each cutter 109 is mounted on pins 129 and 130 secured to the ends thereof. A pin 134 in engagement with a slot 135 provided in an air cylinder 133 supported on the guide plate mounting body 113 is fixed externally of the pin 129 of the pivotable lever 127. The separator mounting plate 125 is formed with a substantially obliquely and rearwardly inclined cam groove 136, with which a further pin 130 of the pivotable lever 127 is engaged.

By the rotation of the yarn gathering levers 112 internally, even in the state where the yarns on the winding package P side are guided into the grooves 107*a* and 111*a* of the guide plates 107 and 111, respectively, yarns $Y_1$ and $Y_2$ are somewhat traversed on both sides of the spread open portion at the deep end of the groove 107*a* of the upper guide plate 107. In the traverse during the parting-winding, the yarns $Y_1$ and $Y_2$ are moved toward and away from each other. When they are moved away from each other, the sensors 110 simultaneously detect the yarns $Y_1$ and $Y_2$ and the air cylinder 133 acts so that the pivotable lever 127 rotates counterclockwise. By the pivotal movement of the pivotable lever 127, the pin 130 is moved within the cam groove 136 of the separator mounting plate 125 to rotate the separator mounting plate 125 clockwise. With this, the separator 108 is projected forwardly from a clearance of a fixed blade 137 of the cutter 109 and enters between the yarns $Y_1$ and $Y_2$ positioned on both sides of the spread open portion at the deep end of the groove 107*a*. By the succeeding traverse, the yarn traversed later, for example, the yarn $Y_2$ moves toward the yarn $Y_1$ precedingly traversed, that is, toward the separator 108 to impinge on the separator 108. In other words, the preceding yarn $Y_1$ is positioned within the range of action of one cutter 109, and the succeeding yarn $Y_2$ is deviated from the range of action of the other cutter 109. When in that state, the pivotable lever 127 rotates counterclockwise, each cutter 109 is further rotated toward the fixed blade 137 so that the preceding yarn $Y_1$ is cut by one cutter 109 but the succeeding yarn $Y_2$ is not cut. That is, even if both the cutters 109 are simultaneously actuated, only the preceding yarn $Y_1$ is cut. Thereafter, the winding package P is reversed one time (that is, the package P is rotated in the direction where the yarn is unwound) whereby the yarn $Y_2$ delayed one round catches up with the preceding yarn $Y_1$ to overcome the separated winding. When the upper yarns are in the normal state, the sellsors 110 will not detect yarns simultaneously, and therefore the air cylinder 133 remains unoperated. When the separated winding is detected, the separated winding detecting operation mentioned above is processed again to confirm whether the separated winding has been overcome. If the separated winding is overcome, the air cylinder 133 is not activated since each of the sensor 110 does not detect a yarn simultaneously. On the other hand, if the separated winding is not overcome, each sensor 110 detects a yarn at the same time so that the air cylinder 133 is actuated to be cut the preceding yarn $Y_1$ by the cutter 109, and the package P is rotated in a reverse direction. This operation is repeated till the separated winding is overcome. In FIG. 13, numeral 138 denotes a monitor to confirm success or failure of the splicing by the splicing device 4.

Since the embodiment of the present invention is configured as described above, it has the effects as mentioned below.

The separated winding of two yarns on the winding package side when the automatic splicing is carried out by the splicing carriage in the doubler can be automatically and positively detected. Therefore, mixing of separated winding which adversely influences in the subsequent steps can be prevented by rotating the winding package by one time in the reversal direction to unwind a yarn after detection.

The separated winding detection apparatus mentioned above is a yarn treating apparatus proposed in assumption that the separated winding occurs actually. However, it is important in a doubler winder to reduce the occurrence of the separated winding as possible.

A doubler winder which enables doubling in a state where one-piece maintaining force caused by fuzz entangling is reinforced.

This embodiment of the present invention provides a doubler winder in which two yarns delivered from two yarn feed packages are drawn together into a single form, which is then wound on a package on a friction roller, the doubler winder comprising an entangler in which fuzz of the drawn two yarns are entangled by a flow of air, and a controller for opening and closing an air closing and opening valve to said entangler every desired intervals according to an angle of rotation of the friction roller.

Every time a friction roller rotates through a predetermined angle $(n+\theta)$, a signal is issued from a controller so that an air opening and closing valve of an entangler is opened and closed. By one opening and closing operation of the air opening and closing valve, air is fed to the entangler once, and the fuzz of the drawn two yarns are entangled by a flow of air. On the other hand, the yarn is placed on the friction roller and wound by a package rotated and driven by the contact, and therefore, the yarn speed is synchronized with a peripheral speed of a package, that is, a rotational speed of the friction roller. Because of this, two yarns drawn into one yarn are such that mutual fuzz are entangled every predetermined angle $(n+0)$ of the friction roller, that is, every interval of predetermined length of yarn to provide an entangled point P.

After all, even in the case where the operating speed of the doubler winder including the start and stop is varied, the entangled point P is formed in completely synchronism with the speed. Therefore, at any yarn speed, the entangled point P is obtained at predetermined intervals. Accordingly, a uniform one-piece force similar to that the fuss entanglement is applied over the full length of the yarn.

Another embodiment of the present invention will be described with reference to the accompanying drawings.

Figure 18:
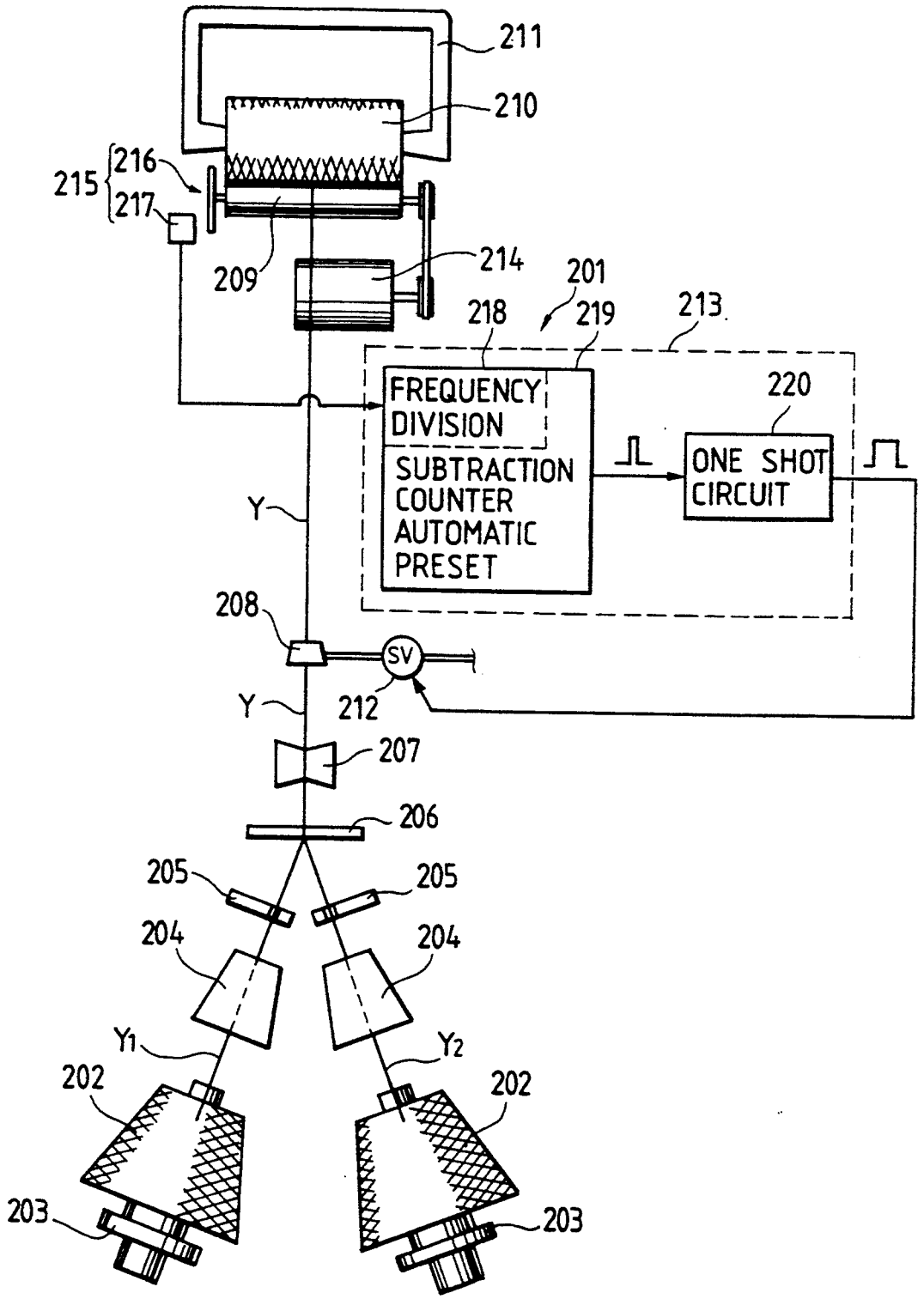
FIG. 18 is a schematic structural view of a doubler winder showing another embodiment of the present invention.

In FIG. 18, numeral 201 denotes a doubler winder. Two yarns $Y_1$ and $Y_2$ drawn out of two yarn feed packages 202 supported on a lower support member 203 pass through a balloon breaker 204 and a yarn sensor 205 and are put together into a single yarn Y and guided upwardly by a yarn guide 206. The gathered yarn Y is applied with a predetermined tension by a tensor 207 and arranged, after which the yarn Y is wound on a winding package 210 on a friction roller 209 while being traversed by an upper traverse drum (not shown) via an entangler 208 added in accordance with the present invention. Numeral 211 denotes a cradle arm for rotatably supporting a take-up tube placed in contact with the friction roller 209 to rotate it. The doubled yarn Y is wound on the take-up tube while being traversed by a traverse drum to thereby form a winding package 210.

Figure 20:
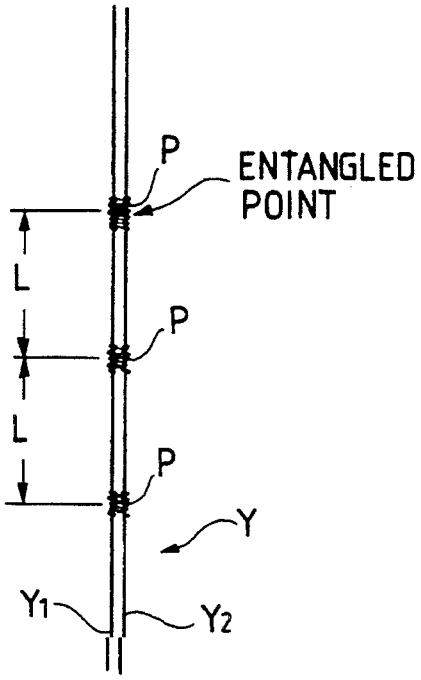
FIG. 20 is a view showing a spacing of an entangled point.
Figure 22:
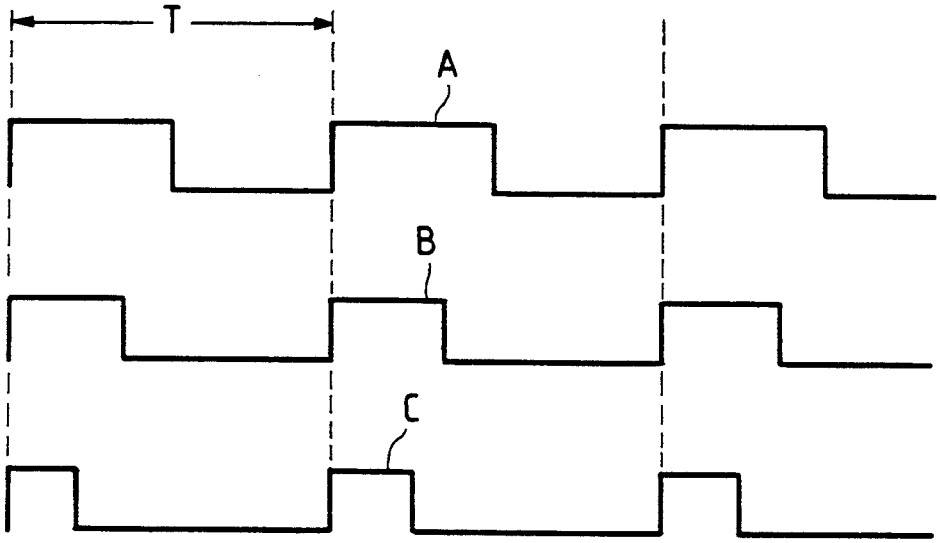
FIG. 22 is a view showing solenoid valve opening and closing modes.

The entangler 208 is a device in which fuzz of two yarns $Y_1$ and $Y_2$ arranged into a single yarn are entangled by a flow of air to provide an entangled point P as shown in FIG. 20, the entangler 208 being connected to an air source (not shown) through a solenoid valve 212 as an air opening and closing valve. The entangled point P is to entangle only the fuzz around the yarn and is not to completely untwist and join the yarn ends together as in a splicing device which makes use of a flow of air. Accordingly, when it is necessary to separate every one yarn to splice every single yarn, a relatively strong tearing force can be applied to again divide the yarn into two yarns Y1 and Y2. The solenoid valve 212 of the entangler 208 is controlled to be opened and closed in accordance with a signal from the controller 213, and the aforementioned entangled point P is made every predetermined intervals L. The entangled point P may be made over the full length of the yarn Y, but such a structure is not provided because a large amount of air is consumed.

The entangled point P is made every predetermined intervals, but this cannot be achieved if the solenoid valve 12 is controlled to be opened and closed at fixed time intervals. The reason why is that the yarn speed of the yarn Y is not always constant.

This will be described in detail. The friction roller 209 is driven by a motor 214 controlled in rotational frequency by an inverter not shown, and is controlled in speed so that the rotational speed of the friction roller 209 is constant. This results in the fact that the peripheral speed of the winding package 210 placed in contact with the friction roller 209 for rotation is made constant and the yarn speed of the yarns Y to be doubled is made constant. However, at the time of rise operation or the at the time of stop of the doubler winder, the rotational frequency of the motor 214 is sometimes varied, the yarn speed is also varied at the time of such variation. Because of this, when the solenoid valve 212 is controlled to be opened and closed at predetermined time intervals, the spacing of preparing position of the entangled point P is uneven.

Figure 19:
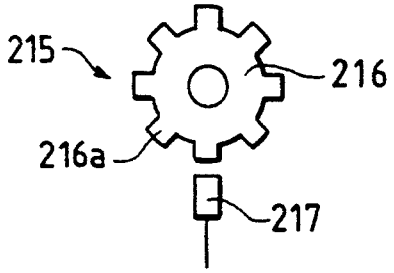
FIG. 19 is a schematic structural view of a rotational angle detector shown in FIG. 18.

A rotational angle detector 215 is provided on the friction roller 209, and a rotational angle detection signal is inputted into the controller 213. In the case of the present embodiment, as shown in FIG. 19, the rotational angle detector 215 is composed of a gear 216 rotated in synchronism with the friction roller 209 and a proximity switch 217 for sensing the passage of the teeth 216*a* of said gear, so that a detection pulse signal of the proximity switch 217 is inputted into the controller 213.

On the controller 213 are provided a frequency divider 218 for dividing a detection pulse signal from the rotational angle detector 215 into 1/100, for example, a subtraction counter 219 for counting pulses after divided, and a one shot circuit 220 actuated upon receipt of an output thereof. The subtraction counter 219 is preset to a count value corresponding to the aforesaid predetermined interval L. When the value is subtracted from the preset value so that the content of the subtraction counter 219 reaches zero, a count output which means a predetermined rotational angle is generated. However, there has an automatic presetting function for automatically returning to a preset value. The one shot circuit 212 produces a pulse having a length enough to drive the solenoid valve 212 upon receipt of the count output.

The solenoid valve 212 is opened by the one shot pulse from the controller 213 so that the flow of air is supplied to the entangler 208 whereby the fuzz of the yarns $Y_1$ and $Y_2$ are entangled. After all, the complete coincidence with the speed of machine (including the start and stop) is made, and at any yarn speed, the entangled point P can be prepared at fixed intervals.

While in the aforementioned embodiment, the controller 213 is provided with the frequency divider 218 and the one shot circuit 220, it is to be noted that these may be omitted as necessary. As a counter, one other than the subtraction counter can be used. Furthermore, the entangler 208 can be disposed between the yarn guide 206 and the tensor 207.

In short, according to the embodiment of the present invention, the mutual fuzz of two yarns drawn into a single yarn are entangled at fixed intervals. Accordingly, the one-piece force is maintained by the force larger than the natural fuzz entangling effect to prevent two yarns from being completely separated and frayed. Because of this, the aforesaid yarn can be handled exactly similar to an ordinary single yarn. It is possible to prevent a problem in that a yarn on a package is subjected to yarn separated winding and unwound deviated in period.

Further, even in the case where the operating speed of the doubler winder including the start and stop is varied, it is completely fallen in that speed, and therefore, the entangled point P is obtained at fixed intervals at any yarn speed.

Still another embodiment of a yarn entangling device in a doubler winder according to this invention comprises a yarn entangling nozzle for jetting a compressed air to an internal yarn passage, a solenoid valve provided in a supply pipe for said compressed air, and a control device for controlling a closing time during a period of one opening and closing of the valve and repeated times of a period of opening and closing per second, the repeated times of the opening and closing period per second being synchronized with a travel speed of a yarn.

In the yarn entangling device in a doubler winder configured as described above, when a jetting period of compressed air from a yarn entangling nozzle is set according to kinds of yarns, yarns drawn out of yarn feed packages of the doubler winder are joined with the fuzz are entangled each other at fixed intervals. Even at the time of rising at the outset of starting operation of the doubler winder, they are joined at fixed intervals similarly to the steady-state operation.

Figure 21:
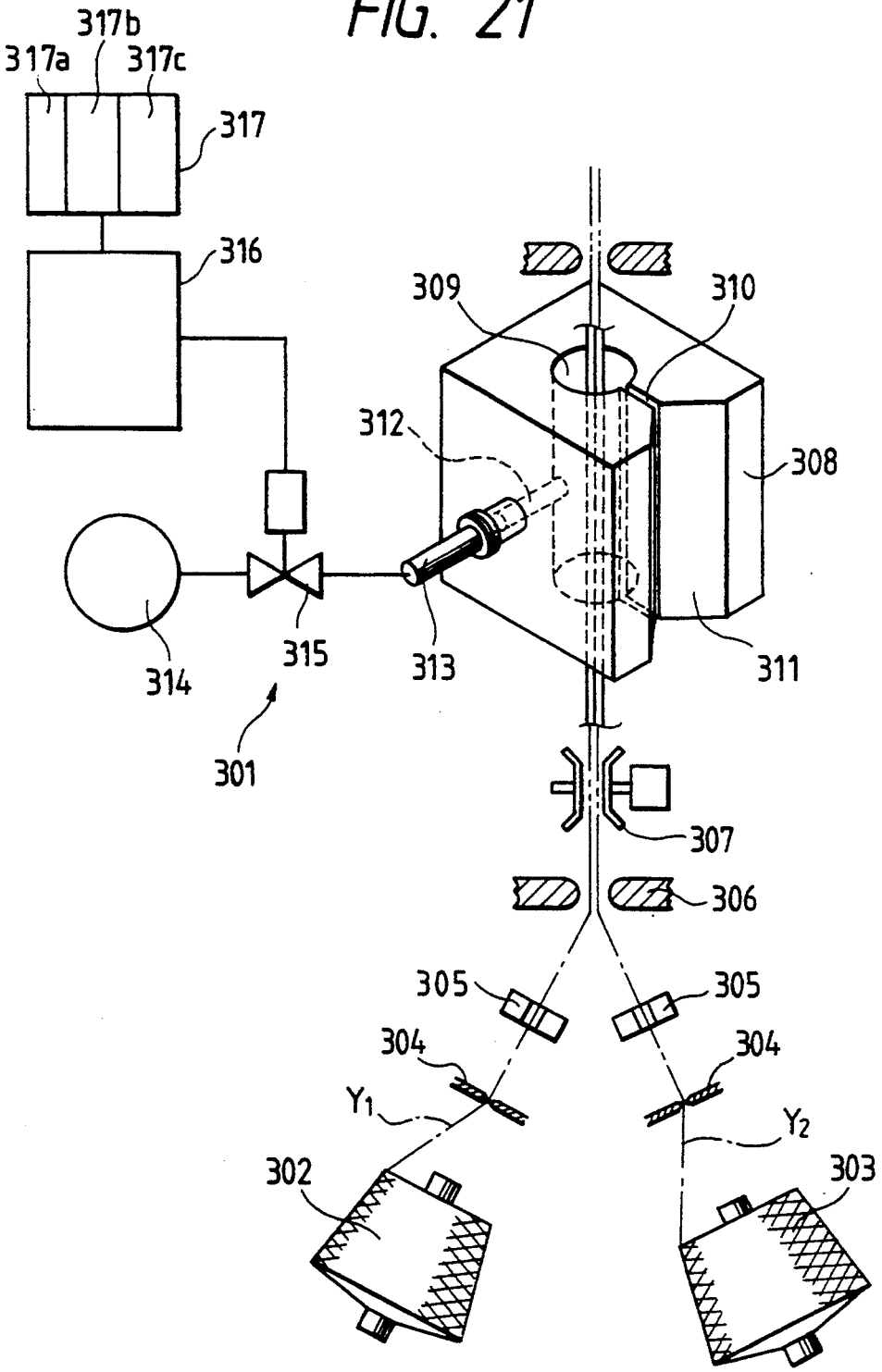
FIG. 21 is a schematic view of a yarn entangling device in a doubler winder.

The embodiment of a yarn entangling device in a doubler winder according to this invention will be described with reference to FIG. 21.

A yarn entangling device 301 is disposed next to a tensor 307 in a doubler in which yarns $Y_1$ and $Y_2$ drawn out of two yarn feed packages 302 and 303 reach a tensor 307 via balloon guides 304, 304, feelers 305, 305 and a yarn guide 306 and are joined thereat, and thence wound on a winding package while being traversed by a traverse drum not shown.

A main part of the yarn entangling device 301 is a yarn entangling nozzle 308 having a yarn passage 309 in the center thereof, which has a tapered opening 11 at an inlet and is provided with a yarn guiding slit 310 in communication with the yarn passage 309. Compressed air is perpendicularly supplied from a pressure air supply pipe 314 to the yarn passage 309 through a hole 312 bored in the yarn entangling nozzle 308 perpendicular to the yarn passage 309 and a supply pipe 313.

When compressed air is periodically supplied from the hole 312 to the yarn passage 309, two yarns $Y_1$ and $Y_2$ are simultaneously moved around within the yarn passage 309, and the fuzz of both the yarns are entangled with each other and partly joined.

A solenoid valve 315 is provided in the midst of the supply pipe 313, and the period of opening and closing thereof is controlled by a command from a controller 316 composed of a microcomputer common to respective spindles.

Numeral 317 denotes an operating panel for setting conditions of periods of opening and closing the solenoid valve 315 to store them in the controller 316, on which panel are provided a power switch 317*a*, a solenoid valve opening and closing mode setting portion 317*b* and a volume setting portion 317*c*.

As the solenoid valve opening and closing modes, there are prepared A, B and C different in open time in one opening and closing period t of the solenoid valve 315. The solenoid valve opening and closing modes A, B and C are open in $\frac{1}{2}$, $\frac{1}{3}$ and $\frac{1}{4}$ of one period, and an air consumption becomes lessened in that order.

The volume is the repeated times (Hz) of the opening and closing period T for one second. The smaller times, the lesser the amount of air consumption. The repeated times of the opening and closing period per second employed in this apparatus is normally 10 to 20 Hz. When the winding speed of the doubler winder is 1000 m, to open and close the solenoid valve 15 once per 1 m of yarn, the repeated times of the opening and closing period per second is 16.7 Hz. This is a standard entangling spacing determined from an economical amount of air consumption and a releasability of yarn of a two-for-one twister.

Further, this volume is synchronized with the rotational frequency of the friction roller for driving the winding package so as to be synchronized with the travel speed of yarn. Accordingly, at the time of rise at the outset of starting operation of the doubler winder, the times of opening and closing the solenoid valve 315 is reduced.

The operation of the doubler winder provided with the yarn entangling device 301 constructed as described above is started in the following manner. First, the power switch 317*a* on the operating panel 317 is closed, the solenoid valve opening and closing mode is then selected according to the kinds of yarns by the solenoid valve opening and closing mode setting portion 317*b*, and the volume, that is, the repeated times of the solenoid valve opening and closing period are set by the volume setting portion 317*c*. Thereafter, when the doubler winder is operated, a preferred entangling is given every fixed intervals of yarns to be doubled.

Since this embodiment is configured as described above, it has the effect as mentioned below.

Since the jetting period of compressed air from the yarn entangling nozzle can be set according to the kinds of yarns, it is possible to always obtain the optimum entangling effect. Further, even at the time of rise at the outset of starting operation of the doubler winder, the optimum entangling effect similar to the steady-state operation can be obtained.

What is claimed is:

1. A driving control device for a winder having a motor for driving a package and a motor for driving a traverse mechanism, comprising:

a friction roller for driving a package;

a first motor for driving the friction roller;

a second motor for driving a traverse cam of a traverse mechanism;

a first rotational sensor provided on a package support mechanism to know rotation of the package;

a second rotational sensor provided on an output shaft of the first motor to know a rotational speed of the friction roller;

a first and a second inverters for controlling the speeds of the motors;

a motor control portion for giving a speed command to these inverters; and a speed setting portion for setting a yarn speed, setting of winding mode and setting of initial value of an winding angle.

2. In a winder having a rotatable friction roller for contacting a package and a traverse mechanism, the package defining a winding speed and a diameter, a method comprising:

providing a first motor for rotating the friction roller, the first motor defining a speed, providing a second motor for running the traverse mechanism, the second motor defining a speed, providing a control device for independently controlling the speed of the first motor and the second motor, monitoring the winding speed of the package, controlling the speed of the second motor in response to the winding speed of the package, monitoring the diameter of the package, using the diameter of the package to calculate a first value, using the winding speed of the package to calculate a reference value, determining the sum of the first value and the reference value, and using the sum of the first value and the reference value to control the speed of the second motor, whereby a plurality of winding patterns are obtained.

3. The method of claim 2, wherein the friction roller defines a rotational speed, wherein the package defines a rotational speed, wherein the step of monitoring the winding speed of the package comprises monitoring the rotational speed of the friction roller, and wherein the step of monitoring the diameter of the package comprises the step of monitoring differences between the rotational speed of the package and the rotational speed of the friction roller.

4. The method of claim 3, comprising providing a first sensor for detecting the rotational speed of the package and generating an output, providing a second sensor for detecting the rotational speed of the friction roller and generating an output, determining a difference between the output of the first sensor and the second sensor, using the difference between the output of the first sensor and the second sensor to calculate a correction value, determining a difference between the correction value and the output of the second sensor, and using the difference between the correction value and the output of the second sensor to control the speed of the first and second motors, whereby a plurality of winding patterns are obtained.

* * * * *